US006024916A

United States Patent [19]

Urita et al.

[11] Patent Number: 6,024,916

[45] Date of Patent: Feb. 15, 2000

[54] CAST COLD TOOL AND METHOD FOR PRODUCING THE SAME

[75] Inventors: Tatsumi Urita, Chita; Kozo Ozaki, Tohkai; Yukinori Matsuda, Nagoya, all of Japan

[73] Assignee: Daido Tokushuko Kabushiki Kaisha, Nagoya, Japan

[21] Appl. No.: 09/048,301

[22] Filed: Mar. 26, 1998

[30] Foreign Application Priority Data

Mar. 31, 1997 [JP] Japan ..... 9-080883

[51] Int. Cl.[7] ..... C21D 9/00; C22C 38/22; C22C 38/24; C22C 38/26

[52] U.S. Cl. ..... 420/110; 420/111; 148/545; 148/622; 148/334

[58] Field of Search ..... 148/545, 622, 148/334; 420/110, 111

[56] References Cited

FOREIGN PATENT DOCUMENTS 58-123861 7/1983 Japan ..... 420/111

59-170240 9/1984 Japan ..... 420/111

260900 1/1970 U.S.S.R. ..... 420/110

*Primary Examiner*—Deborah Yee

*Attorney, Agent, or Firm*—Sughrue, Mion, Zinn, Macpeak & Seas, PLLC

[57] ABSTRACT

A cast cold tool is obtained through the steps of forming a casting by founding a molten steel consisting by weight percentage of 0.5 to 0.8% of C, not more than 1.0% of Si, 0.25 to 1.50% of Mn, 4.0 to 8.0% of Cr, 1.0 to 5.0% of Mo, one or both of 0.2 to 1.0% of V and 0.2 to 2.0% of Nb, opptionally not more than 2.5% of W, not more than 2.5% of Ni, and the balance being Fe plus incidental impurities, subjecting the casting to solid solution treatment to decrease primary carbides precipitated in the casting to not more than 1%, preferably to extinguish completely, and subjecting the solid-solution treated casting to quenching and tempering treatment to give predetermined toughness and hardness to the casting.

15 Claims, No Drawings

CAST COLD TOOL AND METHOD FOR PRODUCING THE SAME

BACKGROUND OF THE INVENTION

1. Field of the Invention

This invention relates to a cast cold tool made of a casting obtained through a founding process and, more particularly to the cast cold tool used for a cold press die, a cold die, a cold header die, an upsetting die and so on, for example, and a method for producing the cast cold tool.

2. Description of the Prior Art

The aforementioned cold tools are ordinarily made through the steps of forming an ingot by solidifying an molten steel having chemical compositions as a tool steel with C content of not less than 1.0% approximately by weight, subjecting the ingot to hot working by rolling or so and cutting out the hot-worked steel into the predetermined shape.

On the other side, complication in the shape of the cold tool is promoted and there is a movement to introduce near net shaping with a background of improvement in yield rate and reduction of the delivery time at the time of producing the cold tool with the complicated conformation.

As a means for coping with the aforementioned near net shaping, it is considered to start the production from a casting body founded in a shape similar to the desired final shape, and it has been investigated to use the casting body also for the cold tool.

However, in a case of using the cast body with chemical compositions of the conventional cold tool steel, it is not so excellent in toughness and there is a problem in that it is not possible to fit for use in the majority of cases.

It is considered as reasons for the low toughness of the casting body having chemical compositions of the cold tool steel that the cast material lacks of structural uniformity and is apt to be lowered in the toughness, coarse primary carbides are precipitated at the time of founding, therefore nonuniform and coarse cast structure deteriorates the toughness of the cast material, the general purpose cold tool steel is rich in C content, so that the toughness is degraded in a state as it is founded, and so on.

SUMMARY OF THE INVENTION

This invention is made in order to solve the aforementioned problem of the prior art, and it is an object to provide a cold tool which has a toughness equal to that of a conventional rolled steel in the transverse direction and an excellent abrasion resistance even when the cold tool is made of a casting body, and is possible to sufficiently cope with a demand for the near net shaping in the background of improvement in yield rate at the time of forming the tool into a complicated shape and reduction of the delivery time.

The cast cold tool according to this invention is characterized in that the cold tool is made of a casting of a steel consisting by weight percentage of 0.5 to 0.8% of C, not more than 1.0% of Si, 0.25 to 1.50% of Mn, 4.0 to 8.0% of Cr, 1.0 to 5.0% of Mo, one or both of 0.2 to 1.0% of V and 0.2 to 2.0% of Nb, and the balance being Fe plus incidental impurities, primary carbides precipitated at the time of founding is controlled to 1% at the most, the cold tool has a toughness substantially equal to that of a rolled steel in the transverse direction and a hardness (abrasion resistance) of not lower than HRC 58.

In embodiments of the cast cold tool according to this invention, W may be contained in the steel up to 2.5%, and Ni may be also contained in the steel up to 2.5%.

In another embodiment of the cast cold tool according to this invention, the primary carbides may be not present substantially or completely.

The method for producing the cast cold tool according to another aspect of this invention is characterized by comprising the steps of forming a casting by founding a molten steel consisting by weight percentage of 0.5 to 0.8% of C, not more than 1.0% of Si, 0.25 to 1.50% of Mn, 4.0 to 8.0% of Cr, 1.0 to 5.0% of Mo, one or both of 0.2 to 1.0% of V and 0.2 to 2.0% of Nb, and the balance being Fe plus incidental impurities, decreasing primary carbides precipitated in the obtained casting at the time of founding to not more than 1% through solid solution treatment in an austenitizing temperature range, and obtaining a cold tool with a toughness substantially equal to that of a rolled steel in the transverse direction and a hardness (abrasion resistance) of not lower than HRC 58 by subjecting the casting to quenching and tempering treatment.

In embodiments of the method for producing the cast cold tool according to this invention, W may be contained in the molten steel up to 2.5%, and Ni may be also contained in the steel up to 2.5%.

In another embodiment of the method for producing the cast cold tool according to this invention, the solid solution treatment may be carried out by holding the casting at a temperature of 1100 to 1250° C. (soaking) to diffuse the primary carbides.

In the other embodiment of the method for producing the cast cold tool according to this invention, the casting may be further subjected to softening treatment such as spheroidizing annealing, softening annealing and the like after the solid solution treatment.

Further in the other embodiment of the method for producing the cast cold tool according to this invention, the primary carbides in the casting are completely or substantially extinguished through the solid solution treatment.

DETAILED DESCRIPTION OF THE INVENTION

The cast cold tool and the method for producing the cast cold tool according to this invention have the aforementioned configuration, and is firstly characterized in that the toughness is improved by reducing C content in the cold tool steel.

Namely, in the cold tool steel on an ordinary occasion, the C content is not lower than 1.0% by weight. C of the order of 0.6 to 0.7 wt % is contained in the matrix of steel and the remainder is contained in carbides. In this invention, therefore, the C content is reduced on a level of C required for the matrix. In this time, there is the possibility of some deterioration in the abrasion resistance according to reduction of the carbides, accordingly the deterioration of the abrasion resistance is prevented as much as possible by homogenizing the structure of steel.

The good abrasion resistance is obtained by securing the hardness of not lower than HRC 58, preferably HRC 60.

With respect to the chemical compositions of the steel, an austenite-monophase range is enlarged by controlling alloying elements and the solid solution treatment (soaking) in the monophase range is made easy.

Furthermore, the toughness is improved by restraining formation of the coarse primary carbides at the time of founding, and by disappearance of the primary carbides (not more than 1% or none at all) and homogenization of the cast structure according to the solid solution treatment applied to the casting obtained through the founding process.

Although it is the original purpose of the solid solution treatment to homogenize the cast structure such as dendrite which is precipitated at the time of founding, a degree of disappearance of the primary carbides is used in this invention as a standard for the homogenization noticing an amount of the primary carbides precipitated at the time of founding as an index of the homogenization of the cast structure.

Explanation will be given below about the reason why the chemical compositions (% by weight) of the cast cold tool and the method for the cast cold tool according to this invention is limited.

C: 0.5 to 0.8%

C is an element effective to improve the hardness of the matrix and contained not less than 0.5% since the hardness is lowered and the abrasion resistance required as the cold tool is degraded when the C content is lower than 0.5%. On the other side, the toughness is lowered, the precipitation of the primary carbides increases and disappearance of the primary carbides through the solid solution treatment becomes difficult if the C content exceeds 0.8%, so that the C content is limited to not more than 0.8%.

Si: not more than 1.0%

Si is an element to be added as a deoxidizer at the time of steel making ordinarily and also the element effective to improve temper softening resistance by containing it in the steel in proper quantity and to improve abrasion resistance and durability. However, the toughness of the matrix is degraded by the excessive addition of Si, so that the upper limit of Si is defined as 1.0%.

Mn: 0.25 to 1.50%

Mn is an element to be added as a deoxidizer at the time of steel making usually and the element also effective to improve hardenability by containing it in the steel in proper quantity and to strengthen the matrix. It is necessary to add Mn of not less than 0.25% in order to obtain such the effects. However, Mn in an excessive amount is harmful to hot workability of the steel, therefore the upper limit of Mn is defined as 1.50%.

Cr: 4.0 to 8.0%

Cr is effective to improve the softening resistance by dissolving in the matrix and has a function to improve the hardenability and the hardness of the steel as precipitates. It is possible to obtain such the effects by containing Cr of not less than 4.0%. However, Cr is limited up to 8.0% because the precipitation of the primary carbides increases at the time of solidification when Cr is contained excessively, and dissolution of the primary carbides becomes difficult even when the casting is subjected to the solid solution treatment.

Mo: 1.0 to 5.0%

Mo is an element effective to improve the temper softening resistance and added not less than 1.0% in order to obtain the effect of this kind. However, if Mo is contained in a large quantity, the precipitation of the primary carbides increases at the time of solidification into the casting and dissolution of primary carbides in the form of $M_6C$ of $M_2C$ becomes difficult at the time of solid solution treatment, therefore the upper limit of Mo is defined as 5.0%.

One or both of 0.2 to 1.0% of V and 0.2 to 2.0% of Nb

V and Nb are elements effective not only to improve the abrasion resistance and sticking resistance but also to refine crystal grains, so that one or both of V and Nb are added not less than 0.2%, respectively in order to obtain such the effects. However, when the content of V and Nb is excessive, the precipitation of the primary carbides increases at the time of solidification into the casting and the primary carbides of MC-type become hard to be dissolved at the time of solid solution treatment, so that the upper limits of V and Nb are defined as 1.0% and 2.0%, respectively.

W: not more than 2.5%

Although W is an element effective for improving the temper softening resistance, the precipitation of the primary carbides increases at the time of solidification of molten steel into the casting and the primary carbides of $M_6C$-type or $M_2C$-type become hard to be dissolved in the matrix at the time of solid solution treatment if W is contained in a large quantity, therefore the upper limit of W is defined as 2.5% even in a case of containing W.

Ni: not more than 2.5%

Ni is an element to improve the toughness by dissolving in the matrix, but such the effect is not improved so much even if Ni is contained in a large quantity and it is unfavorable economically to contain Ni in excess, therefore the upper limit of Ni is defined as 2.5% even in a case of containing Ni.

Fe: remainder

Fe forms the remainder of the steel as the main ingredients of the steel.

In the method for producing the cast cold tool according to this invention, a molten steel having the afore-mentioned chemical compositions is formed into a near net shape according to demand through a founding process, and solid solution treatment (soaking) is carried out for diffusion treatment by holding the obtained casting at an austenitizing temperature range, preferably at a temperature range of 1100~1250° C. In the solid solution treatment, primary carbides precipitated in the casting at the time of founding the casting in the near net shape for example is dissolved in the matrix. Namely, the primary carbides is diffused and extinguished by performing the solid solution treatment in the austenite-monophase range.

Although there may be some difference in the solid solution treatment condition according to the chemical composition, the cooling rate of the casting and so on, it is desirable to carry out the solid solution treatment at a temperature of not lower than 1100° C. because the treatment is not so effective and it becomes necessary to treat for a long time, consequently the treatment becomes uneconomical in a case where the treatment is carried out at a temperature of lower than 1100° C.

On the contrary in a case where the solid solution treatment is carried out at a high temperature exceeding 1250° C., the possibility of liquefaction of the carbides increases as a result of heating the casting up to a temperature exceeding liquidus lines of the carbides. Furthermore the furnace becomes easy to be injured and the solid solution treatment becomes uneconomical, therefore it is preferable to carry out the treatment at a temperature not higher than 1250° C.

However, the temperature for the solid solution treatment should be determined individually so as not to deviate from the austenite-monophase range considering the liquidas lines of the carbides of respective materials and the like. Furthermore, a period for the solid solution treatment should determined appropriately according to size and dendrite space of the precipitated primary carbides and so on.

The primary carbides precipitated at the time of founding is decreased to not more than 1%, preferably extinguished completely by carrying out the above-mentioned solid solution treatment at a temperature in the austenite-monophase range.

Although the principal purpose of the solid solution treatment is to honogenize the cast structure such as dendrite precipitated at the time of founding, a degree of disappearance of the primary carbides is used in this invention as a standard for the homogenization of the cast structure noticing an amount of the primary carbides precipitated at the time of founding as an index of the homogenization.

In this manner, the homogenization of the cast structure is contrived by the solid solution treatment. In this time, it is necessary to reduce the primary carbides to not more than 1% because the toughness is remarkably degraded when the amount of the primary carbides exceeds 1% by weight even after the solid solution treatment.

In this invention, the C content in steel is substantially reduced down to the amount required for the matrix and lack in the hardness may be caused by the insufficient dissolution of the primary carbides. Accordingly, it is desirable to extinguish the primary carbides completely to be nothing at all through the solid solution treatment.

Furthermore, in a case of the casting founded into the near net shape of the desired-shaped cold tool, it is preferable to subject the casting to softening treatment such as spheroidizing annealing, softening annealing and the like after the solid solution treatment according to demand in order to improve the workability of the casting.

EXAMPLE

Invention steels Nos.1 to 10 and comparative steels Nos.11 to 15 having chemical compositions shown in Table 1 were molten by high-frequency induction heating, and testing materials (castings) were obtained by founding the respective molten steels into boat forms in conformity to the JIS Standard of G 0307 (Steel Castings-General Technical Requirements)

TABLE 1

| Steel No. | Chemical composition (wt %) C | Si | Mn | Ni | Cr | Mo | V | W | Nb | Remarks |
|---|---|---|---|---|---|---|---|---|---|---|
| Invention steel | | | | | | | | | | |
| 1 | 0.65 | 0.50 | 0.41 | 0.09 | 6.01 | 1.98 | 0.30 | 0.06 | <0.02 | |
| 2 | 0.60 | 0.50 | 0.39 | 0.09 | 5.96 | 3.96 | 0.31 | 0.07 | <0.02 | |
| 3 | 0.80 | 0.52 | 0.40 | 0.09 | 6.02 | 4.00 | 0.30 | 0.07 | <0.02 | |
| 4 | 0.57 | 0.53 | 0.39 | 0.10 | 4.03 | 4.95 | 0.99 | 0.05 | <0.02 | |
| 5 | 0.50 | 0.49 | 0.40 | 0.10 | 4.06 | 3.02 | 0.30 | 0.06 | <0.02 | |
| 6 | 0.55 | 0.50 | 0.39 | 0.09 | 5.02 | 3.05 | 0.30 | 0.06 | <0.02 | |
| 7 | 0.80 | 0.51 | 0.95 | 0.09 | 4.02 | 2.99 | 0.29 | 0.08 | <0.02 | |
| 8 | 0.58 | 0.52 | 0.40 | 0.10 | 4.05 | 3.00 | 0.30 | 0.06 | 0.49 | |
| 9 | 0.64 | 0.40 | 0.50 | 0.15 | 6.20 | 2.20 | 0.25 | 0.06 | 1.02 | |
| 10 | 0.65 | 0.42 | 0.44 | 0.07 | 5.80 | 1.80 | 0.24 | 1.32 | <0.02 | |
| Comparative steel | | | | | | | | | | |
| 11 | 1.50 | 0.30 | 0.41 | 0.09 | 12.10 | 0.99 | 0.28 | 0.03 | <0.02 | Conventional steel (as cast) |
| 12 | 1.12 | 1.00 | 0.39 | 0.09 | 8.50 | 2.22 | 0.35 | 0.08 | <0.02 | Conventional steel (rolled steel in T-direction) |
| 13 | 1.12 | 1.00 | 0.39 | 0.09 | 8.50 | 2.22 | 0.35 | 0.08 | <0.02 | Conventional steel (as cast) |
| 14 | 1.12 | 1.00 | 0.39 | 0.09 | 8.50 | 2.22 | 0.35 | 0.08 | <0.02 | No.13 (solid solution treatment) |
| 15 | 0.65 | 0.50 | 0.41 | 0.09 | 6.01 | 1.98 | 0.30 | 0.06 | <0.02 | No.1 (without solid solution treatment) |

Next, the testing materials (castings) of invention steels Nos.1 to 10 and comparative steel No.14 were subjected to the solid solution treatment under conditions shown in Table 2. Successively, the testing materials excepting invention steels Nos.5 and 6 were further subjected to the spheroidizing annealing (softening treatment) by slowly cooling after heating at 870° C. for 3 hours.

Subsequently, each of the testing materials (castings) was worked considering removal of the decarborized portion caused by quenching and tempering treatment through rough machining into a shape from which Charpy impact test pieces and Ohgoshi-type abrasion test pieces may be cut out, and the rough-machined testing materials were subjected to the quenching and tempering treatment respectively under the conditions of the quenching temperature and the tempering temperature shown in Table 2. Then, the Charpy impact test pieces and the Ohgoshi-type abrasion test pieces were cut out respectively from the heat treated testing materials (castings) after removing the carborized portions through finish machining.

At the time of Charpy impact test, the Charpy impact value was obtained using an impact test piece with a notch of 10R cut out in the longitudinal direction of the respective testing materials.

Furthermore, the Ohgoshi-type abrasion test was carried out using annealed steel of SCM 415 (chromium molybdenum steel defined by JIS G 4105) as a counter plate to be pressed against the test piece on condition that friction speed is 2.37 m/s and friction distance is 400 m, and the abrasion resistance of the respective testing materials was evaluated using a relative value by standardizing the rolled steel of the conventional cold tool steel (comparative steel No.12).

TABLE 2

| Steel No. | Conditions for heat treatment: Solution treatment Temperature (° C.) | Solution treatment Period (h) | Spheroidizing annealing | Quenching temperature (° C.) | Tempering temperature (° C.) |
|---|---|---|---|---|---|
| Invention steel | | | | | |
| 1 | 1150 | 20 | Practiced | 1030 | 550 |
| 2 | 1150 | 20 | Practiced | 1030 | 560 |
| 3 | 1150 | 20 | Practiced | 1030 | 570 |
| 4 | 1150 | 20 | Practiced | 1030 | 540 |
| 5 | 1200 | 10 | Not practiced | 1030 | 540 |
| 6 | 1200 | 10 | Not practiced | 1030 | 580 |
| 7 | 1200 | 10 | Practiced | 1030 | 560 |

TABLE 2-continued

| Steel No. | Conditions for heat treatment: Solution treatment Temperature (° C.) | Solution treatment Period (h) | Spheroidizing annealing | Quenching temperature (° C.) | Tempering temperature (° C.) |
|---|---|---|---|---|---|
| 8 | 1200 | 10 | Practiced | 1030 | 580 |
| 9 | 1200 | 10 | Practiced | 1030 | 580 |
| 10 | 1200 | 10 | Practiced | 1030 | 580 |
| Comparative steel | | | | | |
| 11 | As cast | — | Practiced | 1030 | 560 |
| 12 | As roll | — | Practiced | 1030 | 560 |
| 13 | As cast | — | Practiced | 1030 | 560 |
| 14 | 1150 | 20 | Practiced | 1030 | 560 |
| 15 | As cast | — | Practiced | 1030 | 550 |

Obtained results of amounts of precipitated primary carbides after solid solution treatment or founding, 10R-Charpy impact values and relateive abrasion losses are shown in Table 3.

TABLE 3

| Steel No. | Hardness (HRC) | Amount of precipitated primary carbides | 10R-Charpy Impact value (J/cm$^2$) | Abrasion loss (Relative value against comparative steel No.12) |
|---|---|---|---|---|
| Invention steel | | | | |
| 1 | 60.5 | 0.0 (after solution treatment) | 16.8 | 1.08 |
| 2 | 60.2 | 0.3 (after solution treatment) | 9.4 | 1.07 |
| 3 | 59.8 | 0.8 (after solution treatment) | 7.9 | 1.02 |
| 4 | 58.2 | 0.3 (after solution treatment) | 9.1 | 1.12 |
| 5 | 58.9 | 0.0 (after solution treatment) | 17.3 | 1.13 |
| 6 | 58.1 | 0.1 (after solution treatment) | 15.8 | 1.11 |
| 7 | 62.1 | 0.3 (after solution treatment) | 10.1 | 0.98 |
| 8 | 58.0 | 0.5 (after solution treatment) | 11.4 | 1.08 |
| 9 | 60.3 | 0.4 (after solution treatment) | 15.2 | 1.07 |
| 10 | 60.0 | 0.5 (after solution treatment) | 15.5 | 1.10 |
| Comparative steel | | | | |
| 11 | 59.8 | 9.8 (as cast) | 2.5 | 1.06 |
| 12 | 62.2 | — (as roll) | 16.5 | 1.00 |
| 13 | 59.8 | 8.4 (as cast) | 3.8 | 1.05 |
| 14 | 61.2 | 4.4 (after solution treatment) | 5.0 | 0.95 |
| 15 | 59.8 | 1.1 (as cast) | 5.3 | 2.10 |

As is evident from Table 3, in the comparative steel No.11, which is a cast steel founded without solid solution treatment and having chemical composition of the conventional cold tool steel with C and Cr in large quantities, precipitation of the carbides is recognized in a considerably large quantity in the casting and the steel is inferior in the toughness remarkably.

The comparative steel No.12, which is a rolled steel obtained by hot-rolling the ingot of the conventional cold tool steel having chemical compositions with C and Cr in relatively large quantities, shows high impact value and is excellent in the abrasion resistance. However, it is difficult to cope with the requirement for the near net shape in the background of improvement in yield rate and reduction of the delivery time by the rolled steel of this kind as explained concerning the prior art.

In the comparative steel No.13, which is a cast steel obtained by founding without solid solution treatment and having chemical compositions of the conventional cold tool steel with relatively high C and Cr, precipitation of the carbides is observed in a considerably large quantity in the casting and the steel is inferior in the toughness.

Further, in the comparative steel No.14, which is a cast steel subjected to the solid solution treatment and having chemical compositions of the conventional cold tool steel with relatively high C and Cr, it is not possible to reduce the primary carbides sufficiently by dissolusion, so that the steel is not so excellent in the toughness.

Furthermore, in the comparative steel No.15, which is a cast steel founded without solid solution treatment and having chemical compositions according to this invention, precipitation of the carbides is observed in a relatively large quantity because the solid solution treatment is not applied, and the steel is inferior not only in the toughness but also in the abrasion resistance since the cast structure is not homogenized.

In contrast with the above, each of the invention steels Nos.1 to 10 has the toughness substantially equal to that of the rolled steel in the transverse direction and the abrasion resistance, which are in the same degree as the conventional hot-rolled tool steel (comparative steel No.12), and possible to cope with the demand for the near net shape sufficiently for the background of improvement in yield rate of the cold tool in complicated shape and reduction of the delivery time because the cold tool according to this invention is formed through the founding process.

As mentioned above, the cast cold tool according to this invention is made of a casting of a steel consisting by weight percentage of 0.5 to 0.8% of C, not more than 1.0% of Si, 0.25 to 1.50% of Mn, 4.0 to 8.0% of Cr, 1.0 to 5.0% of Mo, one or both of 0.2 to 1.0% of V and 0.2 to 2.0% of Nb, and the balance being Fe plus incidental impurities, has a toughness substantially equal to that of a rolled steel in the transverse direction and a hardness of not lower than HRC 58 and primary carbides precipitated at the time of founding is controlled to 1% at the most, therefore the cast cold tool has the excellent toughness and abrasion resistance equal to those of the conventional rolled cold tool steel with high C content. Additionally, a remarkable effect can be obtained in that it is possible to sufficiently cope with the requirement for the near net shape for the background of improvement in yield rate of the complicate-shaped cold tool and reduction of the delivery time because the cold tool according to this invention is made of the casting through the founding process.

In the embodiments of the cast cold tool according to this invention, it is possible to further improve the temper softening resistance by containing W of not more than 2.5% in the steel and possible to further improve the toughness by containing Ni of not more than 2.5% in the steel.

Furthermore, in another embodiment of the cast cold tool according to this invention, it is possible to provide the cold tool excellent in the toughness in spite of casting made tool by extinguishing the primary carbides substantially or completely.

In the method for producing the cast cold tool according to another aspect of this invention, a casting is formed by founding a molten steel consisting by weight percentage of 0.5 to 0.8% of C, not more than 1.0% of Si, 0.25 to 1.50% of Mn, 4.0 to 8.0% of Cr, 1.0 to 5.0% of Mo, one or both of 0.2 to 1.0% of V and 0.2 to 2.0% of Nb, and the balance being Fe plus incidental impurities, and the obtained casting is subjected to solid solution treatment at an oustenitizing temperature range in order to decrease primary carbides precipitated at the time of founding to not more than 1%, subsequently the casting is further subjected to quenching and tempering treatment in order to the cold tool with a toughness substantially equal to that of a roll steel in the transverse direction and a hardness of not lower than HRC 58. Therefore, an excellent effect can be obtained in that it is possible to produce the cold tool which has the excellent toughness and abrasion resistance equal to those of the conventional rolled cold tool steel with high C content and capable of coping with the requirement for the near net shape for the background of improvement in yield rate of the complicate-shaped cold tool and reduction of the delivery time.

In the embodiments of the production method according to this invention, it is possible to further improve the temper softening resistance of the cold tool by containing W of not more than 2.5% in the steel and possible to further improve the toughness of the cold tool by containing Ni of not more than 2.5% in the steel.

In another embodiment of the production method according to this invention, it is possible to decrease the primary carbides precipitated at the time of founding to not more than 1% or to extinguish completely and possible to produce the cast cold tool having the high toughness through the solid solution treatment for holding the casting at a temperature of 1100° C. to 1250° C. to diffuse the primary carbides.

Further, in the other embodiment of the production method according to this invention, it is possible to further improve workability in a case of finishing the solution treated casting into the cold tool with a desired shape by subjecting the casting to the softening treatment such as spheroidizing annealing, softening annealing and the like after the solid solution treatment.

Furthermore, in the other embodiment of the production method for the cast cold tool according to this invention, it is possible to produce the cast cold tool having the remarkably improved toughness by extinguishing the primary carbides substantially or completely in spite that the tool is made of a casting.

What is claimed is:

1. A cast cold tool made of a casting of a steel consisting by weight percentage of 0.5 to 0.8% of C, not more than 1.0% of Si, 0.25 to 1.50% of Mn, 4.0 to 8.0% of Cr, 1.0 to 5.0% of Mo, one or both of 0.2 to 1.0% of V and 0.2 to 2.0% of Nb, and the balance being Fe plus incidental impurities, and having a toughness of not lower than 7.9 J/cm$^2$ of 10R-Charpy impact value and a hardness of not lower than HRC 58, wherein primary carbides precipitated at the time of founding is controlled to 1% by weight at the most.

2. A cast cold tool as set forth in claim 1, wherein said steel further contains W of not more than 2.5%.

3. A cast cold tool as set forth in claim 1, wherein said steel further contains Ni of not more than 2.5%.

4. A cast cold tool as set forth in claim 2, wherein said steel further contains Ni of not more than 2.5%.

5. A cast cold tool as set forth in claim 1, wherein said primary carbides are not present substantially or completely.

6. A method for producing a cast cold tool comprising the steps of:

forming a casting by founding a molten steel consisting by weight percentage of 0.5 to 0.8% of C, not more than 1.0% of Si, 0.25 to 1.50% of Mn, 4.0 to 8.0% of Cr, 1.0 to 5.0% of Mo, one or both of 0.2 to 1.0% of V and 0.2 to 2.0% of Nb, and the balance being Fe plus incidental impurities;

decreasing primary carbides precipitated in the obtained casting at the time of founding to not more than 1% by weight through solid solution treatment in an austenitizing temperature range; and obtaining a cold tool with a toughness of not lower than 7.9 J/cm$^2$ of 10R-Charpy impact value and a hardness of not lower than HRC 58 by subjecting said casting to quenching and tempering treatment.

7. A method for producing a cast cold steel as set forth in claim 6, wherein said molten steel further contains W of not more than 2.5%.

8. A method for producing a cat cold steel as set forth in claim 6, wherein said molten steel further contains Ni of not more than 2.5%.

9. A method for producing a cast cold steel as set forth in claim 7, wherein said molten steel further contains Ni of not more than 2.5%.

10. A method for producing a cast cold steel as set forth in claim 6, wherein said solid solution treatment is carried out by holding said casting at a temperature of 1100 to 1250° C. to diffuse the primary carbides.

11. A method for producing a cast cold tool as set forth in claim 6, wherein said casting is further subjected to softening treatment after the solid solution treatment.

12. A method for producing cast cold tool as set forth in claim 10, wherein said casting is further subjected to softening treatment after the solid solution treatment.

13. A method for producing a cast cold tool as set forth in claim 6, wherein said primary carbides in the casting are completely or substantially extinguished through the solid solution treatment.

14. A method for producing a cast cold tool as set forth in claim 10, wherein said primary carbides in the casting are completely or substantially extinguished through the solid solution treatment.

15. A method for producing a cast cold tool as set forth in claim 12, wherein said primary carbides in the casting are completely or substantially extinguished through the solid solution treatment.

* * * * *